United States Patent [19]

Tate

[11] Patent Number: 4,568,085

[45] Date of Patent: Feb. 4, 1986

[54] SPINNING TARGET ASSEMBLY

[75] Inventor: David L. Tate, Woodridge, Ill.

[73] Assignee: Wico Corporation, Niles, Ill.

[21] Appl. No.: 604,884

[22] Filed: Apr. 27, 1984

[51] Int. Cl.[4] ..... A63B 67/10

[52] U.S. Cl. ..... 273/127 D

[58] Field of Search ..... 273/361, 362, 366, 367, 273/395, 119 A, 118 A, 120 A, 121 A, 122 A, 123 A, 124 A, 125 A, 127 R, 127 A, 127 D, 127 B, 127 C, 370, 371, 390; 200/61.11; 377/15

[56] References Cited

U.S. PATENT DOCUMENTS

| | | | |
|---|---|---|---|
| 3,857,567 | 12/1974 | Goldfarb et al. | 273/123 A |
| 3,899,170 | 8/1975 | Parks | 273/127 D |
| 4,039,188 | 8/1977 | Goldfarb et al. | 273/127 D |
| 4,235,438 | 11/1980 | Hally | 273/127 D |
| 4,237,374 | 12/1980 | Malone | 377/15 |
| 4,322,082 | 3/1982 | Peters | 273/127 D |

*Primary Examiner*—Richard C. Pinkham
*Assistant Examiner*—T. Brown
*Attorney, Agent, or Firm*—Emrich & Dithmar

[57] ABSTRACT

The spinning target assembly comprises a pair of posts and a bridge therebetween. Three spinning target units hang downwardly from the bridge. The units move back and forth between the posts. Each unit includes a pair of supports and a target therebetween rotatably carried thereby. Two Hall-effect devices are mounted in each support and a magnet is mounted in the spinning target, whereby the Hall-effect devices can sense the direction and number of revolutions of the target.

9 Claims, 8 Drawing Figures

SPINNING TARGET ASSEMBLY

BACKGROUND OF THE INVENTION

In a pinball game, a ball is propelled onto a playfield board which carries various targets. Points are awarded when these targets are struck by the ball. A spinning target assembly includes two posts and a platelike member rotatably mounted therebetween. When a ball strikes the member, it is caused to spin as the ball passes between the posts. Such a spinning target assembly is disclosed in U.S. Pat. No. 4,322,082 which is assigned to the assignee of the present application.

The posts of prior art spinning target assemblies are fixed in place on the playfield board. It would add excitement in playing the pinball game to reciprocate the spinning target from time to time or continuously. But, that is not possible with prior art assemblies which are attached to the playfield board.

Prior art spinning target assemblies, such as are disclosed in the above-mentioned patent, incorporate a switch which is opened and closed as the target spins. The switch is mechanical, and is, therefore, not likely to last as long as an electronic switch. Moreover, a mechanical switch can sense the number of revolutions of the rotating member, but not the direction of rotation.

SUMMARY OF THE INVENTION

It is, therefore, an important object of the present invention to provide a spinning target assembly in which the spinning member reciprocates from time to time or continuously.

Another object is to provide a spinning target assembly in which the switch that senses spinning of the spinning member is electronic rather than mechanical.

In summary, there is provided a spinning target assembly for a pinball game having a playfield board on which a pinball rolls, comprising at least one upstanding post on the playfield board, a bridge carried by the post and positioned above the playfield board, at least one spinning target unit hanging downwardly from the bridge, and driving means for moving the spinning target along the bridge.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENT

Figures 1, 2, 3, 4:
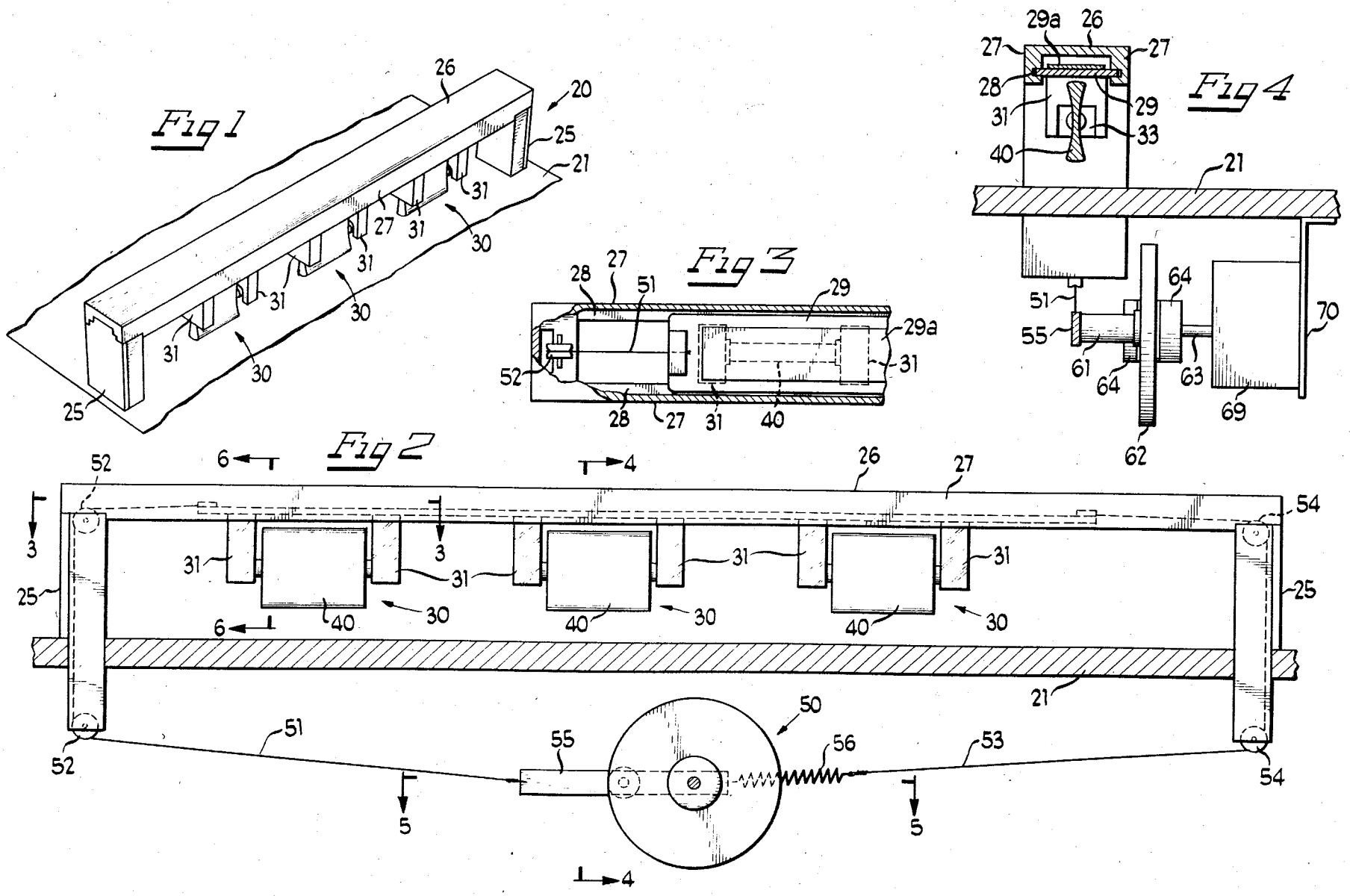
FIG. 1 is a fragmentary view of the top surface of a playfield board which carries a spinning target assembly incorporating the features of the present invention.
FIG. 2 is an elevational view of the spinning target assembly of FIG. 1 on an enlarged scale, the playfield board being shown in cross section.
FIG. 3 is a fragmentary view in horizontal section taken along the line 3—3 of FIG. 2.
FIG. 4 is a view in vertical section taken along the line 4—4 of FIG. 2.

Turning now to the drawings and more particularly to FIG. 1 thereof, there is illustrated a spinning target assembly, generally designated by the numeral 20, constructed in accordance with and embodying the features of the present invention and adapted to be mounted on a playfield board 21 of a pinball game. In use, a pinball (not shown) rolls along the top surface of the playfield board 21 in a well-known manner. The spinning target assembly 20 comprises a pair of spaced-apart posts 25 that are hollow and have a portion that extends through the playfield board 21, as can be seen in FIGS. 2 and 4. A bridge 26 spans the posts 25, the bridge 26 having depending side walls 27 (FIG. 4) each with a longitudinally extending, inwardly facing slit 28. The slits 28 are at the same height and define a pair of tracks for slidably receiving an elongated carriage plate 29. Attached to the carriage plate 29 is a printed circuit board **29*a*** carrying plating.

Figure 6:
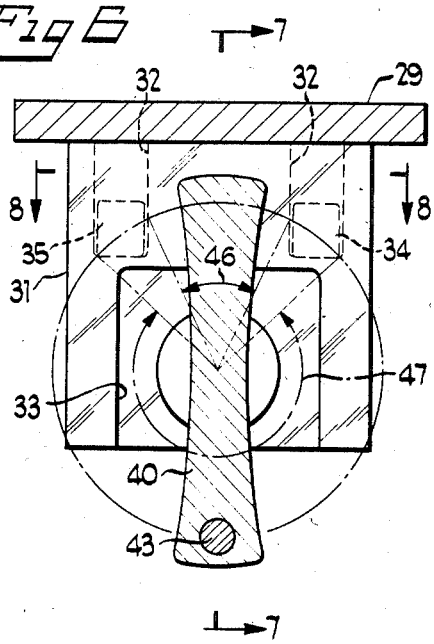
FIG. 6 is an enlarged view in vertical section taken along the line 6—6 of FIG. 2.
Figure 7:
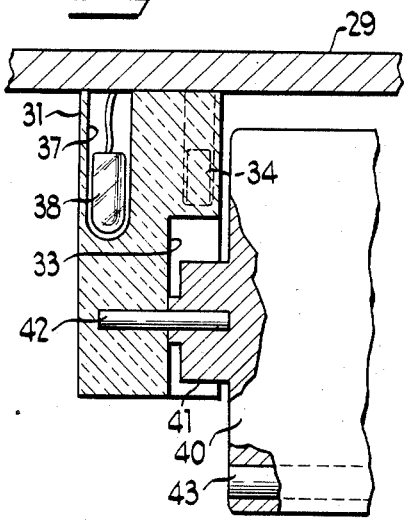
FIG. 7 is a view in vertical section taken along the line 7—7 of FIG. 6.
Figure 8:
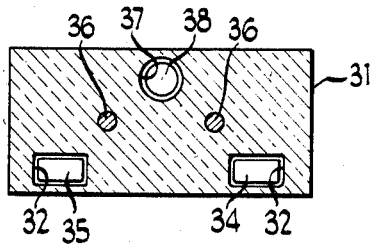
FIG. 8 is a view in horizontal section taken along the line 8—8 of FIG. 6.

The spinning target assembly 20 comprises a plurality of substantially identical units 30. Each unit 30 includes a pair of spaced-apart supports 31 affixed to and depending from the carriage plate 29. Each of the supports 31 is generally in the shape of a rectangular block. A pair of laterally spaced-apart recesses 32 extend downwardly into the body of the support 31. A recess 33 in the side of each support 31 opens toward the matching support of each unit 30. The recesses 32 respectively receive Hall-effect devices 34 and 35 (FIGS. 6–8). Such devices in the embodiment shown are generally square in cross section and snugly fit in the recesses 32 and are located at the bottoms thereof. Hall-effect devices are electronic switches that are closed in the presence of a magnet field and open in the absence of such field.

Each support 31 is attached to the carriage plate 29 by means of screws 36 passing therethrough and into the support 31. Each support 31 further includes a bore 37 within which is located a bulb 38.

Each unit 30 includes a target 40 which is generally platelike, but in the embodiment shown, has concave wall surfaces as can be best seen in FIG. 6. The target 40 has hubs 41 protruding from the sides thereof through which hubs pass pins 42 that are journaled into the supports 31. The hubs 41 are respectively located partly within the recesses 33, as is best seen in FIG. 7. The target 40 is thus rotatably mounted on the associated supports 31. A rod-like magnet 43 is carried by the target 40 substantially parallel to the pins 42 and spaced therefrom.

When a ball is propelled onto the playfield board 21, it can strike the target 40 of one of the units 30 at the rear, causing the target to spin. Also, the ball can be propelled by, for example, the "flippers" (not shown), toward the front of the target 40, to rotate it in the opposite direction.

When the target 40 rotates, the magnet 43 is brought to a position adjacent to the Hall-effect device 34 so as to close the same. When brought to a position adjacent to the Hall-effect device 35, that device is closed. The leads (not shown) of the Hall-effect devices 34 and 35 are connected to electronic circuitry which is adapted to sense the closure of such switches. Such electronic circuitry can count the number of times either or both devices is opened or closed and, if desired, the score can reflect the number of revolutions.

Moreover, each unit 30 can sense the direction of revolution of the target 40 so that a different score can be awarded, if desired, when the ball is delivered through the front of the unit 30 rather than its rear. The unit 30 is capable of such determination in the following way. When the target rotates clockwise, as viewed in FIG. 6, the device 34 will be closed shortly after the device 35 is closed, as represented by the angle 46. On the other hand, there will be a relatively longer time until the next closure of the device 35, as represented by the angle 47. When the target 40 rotates counterclockwise, there is a relatively short time between closure of the device 34 and the ensuring closure of the device 35, and a relatively longer time to the next closure of the device 34. This difference can be sensed by the electronic circuit to which the devices 34 and 35 are connected.

The three units 30 move together back and forth between the posts 25. Toward the end, the spinning target assembly 20 further comprises a driving mechanism 50 which, in turn, includes a cable 51 connected to one end of the carriage plate 29, and around two pulleys 52 located within one of the posts 25 at the ends thereof. A second cable 53 is connected to the other end of the carriage plate 29 and passes around a pair of pulleys 54 located in the other post 25 at the ends thereof. The other end of the cable 51 is connected to a strip 55. A spring 56 is connected between the other end of the strip 55 and the remaining end of the cable 53.

Figure 5:
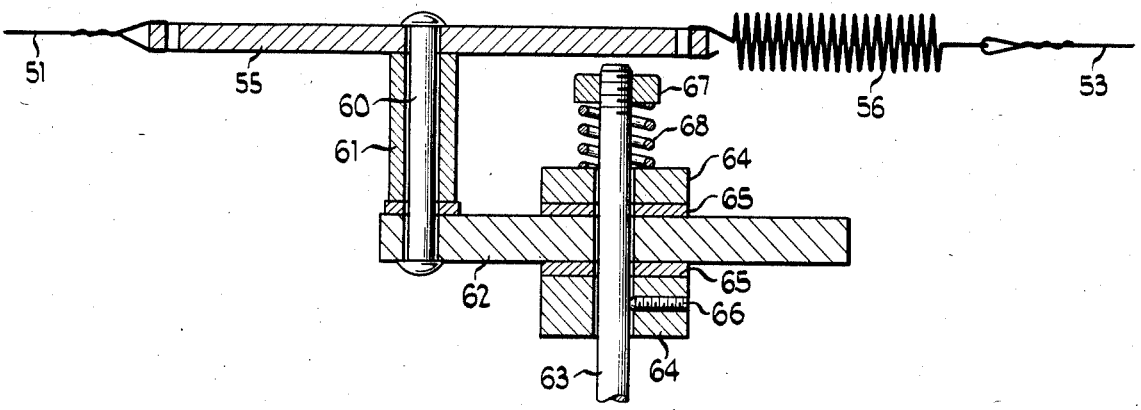
FIG. 5 is a fragmentary view in horizontal section taken along the line 5—5 of FIG. 2.

As is best seen in FIG. 5, a pin 60 is attached to the strip 55, extends through a spacer sleeve 61 and is attached to a disk 62 adjacent to the periphery thereof. A shaft 63 passes through the center of the disk 62. Two plates 64, each having an associated cork washer 65, are respectively disposed on opposite sides of the disk 62. One of the plates 64 has a set screw 66 extending therethrough to engage the shaft 63. A nut 67 is threaded onto the free end of the shaft 63 and a spring 68 is located between the nut 67 and the other plate 64. The parts 64–68 define a clutch by which the disk 62 is frictionally held between the cork washers 65. The shaft 63 is connected to a motor 69 (FIG. 4) which is mounted on a bracket 70 attached to the underside of the playfield board 21. When the motor is operated, the shaft 63 rotates, which rotation is translated into rotation of the disk 62 through the clutch mechanism, thereby eccentrically rotating the pin 60 and reciprocating the strip 55 back and forth. Such motion is translated through the cables 51 and 53, causing the carriage plate 29 to slide back and forth in the tracks defined by the slits 28. The units 30 carried by the plate 29 are thus continuously reciprocated between the posts 25.

If desired, the motor 69 can be controlled so that the units 30 stop from time to time, reverse direction, change speed, etc., depending on the score or other factors.

The posts 25, the bridge 26 and the supports 31 are preferably constructed of plastic. Preferably, at least the supports 31 are transparent or translucent so that the bulbs 38 can illuminate them. The electronic circuitry to which mention was previously made can illuminate such bulbs as the result of various factors such as score. For example, the supports 31 of any one of the units 30 may be illuminated, signifying that striking the corresponding target 40 at that instant would yield a greater score.

Accordingly, there has been described a spinning target assembly which has units that are not fixed in place on the playfield board, but rather reciprocate. Each unit incorporates a spinning target which carries a magnet that operates Hall-effect devices. Although a specific embodiment has been shown and described, it is to be understood that various changes can be made and still come within the scope of the following claims. The driving mechanism 50, for example, is merely exemplary.

I claim:

1. A spinning target assembly to be used in a pinball game apparatus having a playfield board on which a pinball rolls, comprising an upstanding post on the playfield board, a bridge carried by said post and positioned above said playfield board, at least one spinning target unit movably mounted on and hanging downwardly from said bridge for engagement by a pinball rolling along the playfield board, and driving means for moving said spinning target along said bridge independently of the spinning of said target.

2. The spinning target assembly of claim 1, and further comprising carriage means on said bridge and movable with respect thereto, said spinning target unit hanging downwardly from said carriage means.

3. The spinning target assembly of claim 1, and comprising a plurality of spinning target units hanging downwardly from said bridge.

4. The spinning target assembly of claim 1, and further comprising a second upstanding post on said playfield board, said bridge being carried by both of said posts.

5. The spinning target assembly of claim 1, wherein said driving means is continuously operative to continuously move said spinning target unit back and forth.

6. The spinning target assembly of claim 1, wherein said spinning target unit includes a pair of supports depending from said bridge and a target member therebetween and rotatably mounted thereto.

7. The spinning target assembly of claim 6, wherein each of said supports is translucent or transparent and includes illumination means mounted therein.

8. A spinning target assembly to be used in a pinball game apparatus having a playfield board on which a pinball rolls, comprising at least one upstanding post on the playfield board, a bridge carried by said post and positioned above said playfield board, at least one spinning target unit movably mounted on and hanging downwardly from said bridge for engagement by a pinball rolling along the playfield board, said spinning target unit including a pair of supports depending from said bridge and a target member therebetween and rotatably mounted thereto, means for providing electrical signals representative of the number of revolutions of said spinning target, and driving means for moving said spinning target along said bridge.

9. The spinning target assembly of claim 8, and said means for providing electrical signals further indicating the direction of revolution of said spinning target.

* * * * *